US008177104B2

(12) United States Patent
Bryant

(10) Patent No.: US 8,177,104 B2
(45) Date of Patent: May 15, 2012

(54) CAP DRYING APPARATUS

(76) Inventor: Carl E. Bryant, San Diego, CA (US)

( * ) Notice: Subject to any disclaimer, the term of this patent is extended or adjusted under 35 U.S.C. 154(b) by 608 days.

(21) Appl. No.: 12/339,305

(22) Filed: Dec. 19, 2008

(65) Prior Publication Data

US 2009/0166388 A1 Jul. 2, 2009

Related U.S. Application Data

(60) Provisional application No. 61/016,709, filed on Dec. 26, 2007.

(51) Int. Cl.
*A42B 1/04* (2006.01)

(52) U.S. Cl. ..... 223/13; 223/12

(58) Field of Classification Search ..... 223/12, 223/13, 15, 21, 23–25; 33/12, 13, 15, 21, 33/23–25
See application file for complete search history.

(56) References Cited

U.S. PATENT DOCUMENTS

| | | | | |
|---|---|---|---|---|
| 716,251 | A | 12/1902 | Lamont | |
| 1,742,397 | A | 1/1930 | Kauffmann | |
| 2,129,720 | A | 9/1938 | Wilhelm | |
| 2,490,508 | A * | 12/1949 | Delgatto | 223/23 |
| 2,536,913 | A | 1/1951 | Cox et al. | |
| 4,491,256 | A | 1/1985 | Payne et al. | |
| 4,708,271 | A | 11/1987 | Grommes | |
| 4,941,601 | A | 7/1990 | Thomas et al. | |
| 5,148,954 | A | 9/1992 | Myers | |
| 5,161,719 | A | 11/1992 | Otteson et al. | |
| 5,172,837 | A * | 12/1992 | Finney et al. | 223/23 |
| 5,725,134 | A | 3/1998 | Weltge | |
| 6,253,973 | B1 * | 7/2001 | Jones | 223/67 |
| 6,968,985 | B1 | 11/2005 | Caccavallo | |

* cited by examiner

*Primary Examiner* — Shaun R Hurley
*Assistant Examiner* — Andrew Sutton
(74) *Attorney, Agent, or Firm* — James Ray & Assoc

(57) ABSTRACT

A cap drying and shaping apparatus includes a substantially planar base, an inflatable bladder disposed proximal one end of the planar base, and a ribbed cage member. The ribbed cage member includes a domed portion having a predetermined radius to the apex and a predetermined diameter parallel to the planar base, and a planar portion at least as long and wide as a bill on a typical ball cap. Attachment means are disposed on top of the planar base for removably clamping the ribbed cage member to the planar base.

14 Claims, 3 Drawing Sheets

CAP DRYING APPARATUS

CROSS REFERENCE TO RELATED APPLICATION

This patent application is related to and claims priority from U.S. Provisional Patent Application Ser. No. 61/016,709 filed Dec. 26, 2007.

FIELD OF THE INVENTION

The present invention relates, in general, to drying headgear and, more particularly, this invention relates to holding the shape of ball caps while drying and storing them.

BACKGROUND OF THE INVENTION

Prior to the conception and development of the present invention, hat and cap owners have sought ways to dry their headgear after laundering or getting it wet while still retaining the shape of the hat or cap. Wrinkles can easily appear during drying or even normal storage.

Over many years, numerous devices have been proposed for preserving the shape of hats or caps during storage and/or drying. Inflatable hat blocks have been disclosed in U.S. Pat. Nos. 716,251, 1,742,397, 2,129,720, and 2,536,913; however, these devices did not comprehend billed caps. In addition, they do not have a base that could be used to clamp a cap bill in position thereon. There have been several prior art patents disclosing various means of preserving the shape of caps, including U.S. Pat. Nos. 4,941,601, 5,148,954, 5,161,719, 5,725,134, and 6,968,985. All of these last five utilize some sort of rigid or mechanically adjustable insert that fits inside the cap. In U.S. Pat. No. 4,491,256, Payne et al disclose a drying insert for caps that has clips for engaging with the bill of a cap, but the cage-like insert fits inside the cap and is not adjustable to a range of sizes. Grommes in U.S. Pat. No. 4,708,271 discloses a drying form for wet caps that clamps the bill to a base, but there is no inflatable device and nothing to create or maintain curvature in the bill.

SUMMARY OF THE INVENTION

The present invention provides a cap drying and shaping apparatus which includes a substantially planar base, an inflatable bladder disposed proximal one end of the planar base, and a ribbed cage member. The ribbed cage member includes a domed portion having a predetermined radius to the apex and a predetermined diameter parallel to the planar base, and a planar portion at least as long and wide as a bill on a typical ball cap. Attachment means are disposed on top of the planar base for removably clamping the ribbed cage member to the planar base.

In an alternative embodiment of the present invention, a concave block near a central portion of the base ensures curvature in the bill of the cap.

OBJECTS OF THE INVENTION

It is, therefore, one of the primary objects of the present invention to enable ball caps to be dried wrinkle free.

Another object of the present invention is to provide a drying kit for ball caps that provides both inner and outer support for keeping caps smooth during the drying process and storage.

Still another object of the present invention is to provide a simple, inexpensive, and adjustable support for ball caps that can provide uniform inside pressure such that the outer surface of the cap dries smooth and wrinkle free.

Yet another object of the present invention is to provide a cap support apparatus for maintaining the appearance of a cap during storage.

An additional object of the present invention is to provide at least one method of maintaining a curvature in the bill of the cap being dried.

In addition to the various objects and advantages of the present invention described with some degree of specificity above, it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
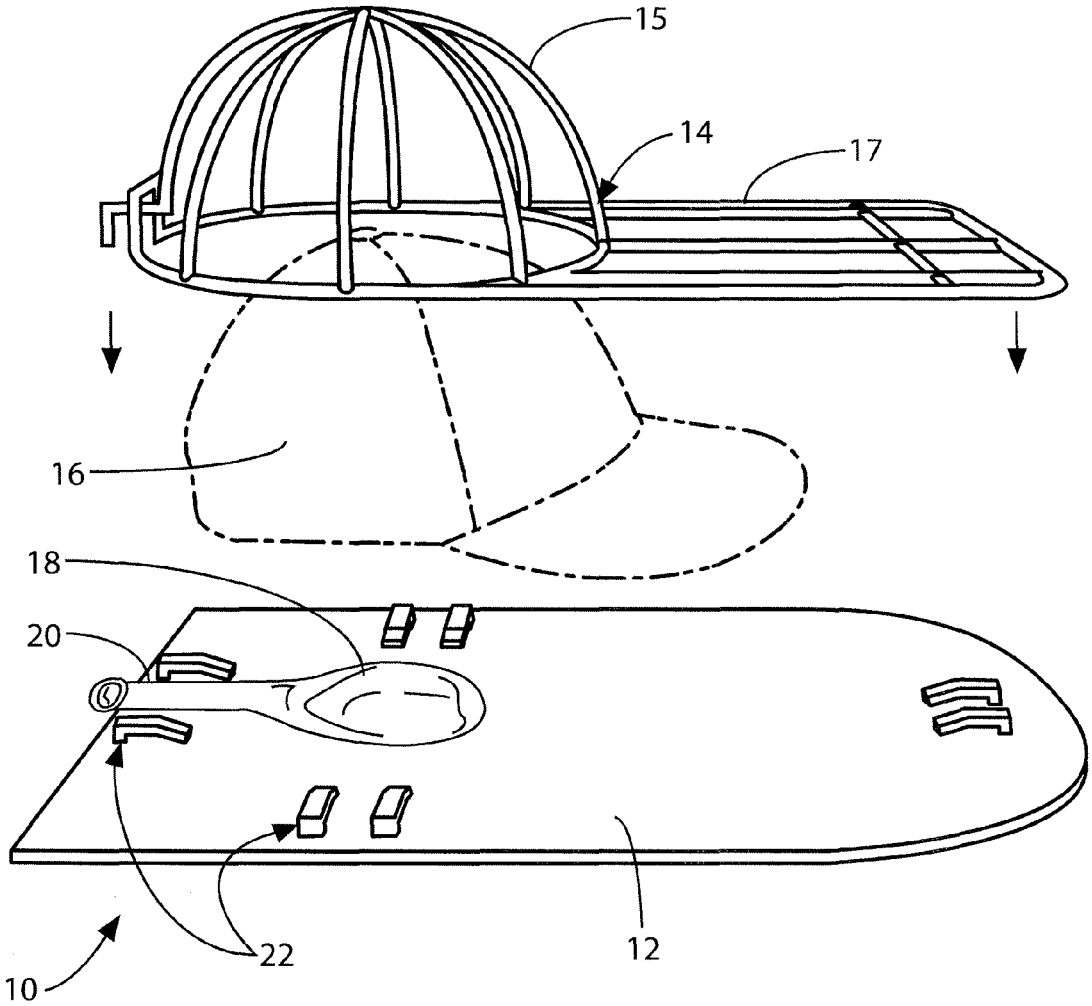
FIG. 1 is an exploded perspective view of the present invention in combination with a ball cap.

DETAILED DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Referring initially to FIG. 1, the apparatus, generally designated 10, of the present invention is shown in an exploded perspective view. The flat base 12 has clamps 22 spaced adjacent the periphery of the base 12. A deflated or partially deflated bladder, or balloon 18, is disposed adjacent an end of the base 12 with the inflation stem 20 protruding just beyond the proximal edge of the base 12. A ball cap 16 to be dried, or stored, is to be positioned with the crown section over the balloon 12. A ribbed cage member 14 is positioned above the cap 16 with the dome section 15 placed over the crown section of the cap 16 and a bill section 17 over the bill of the cap 16. The ribbed cage 14 is then removably engaged with the base 12 with the aid of spring-loaded clamps 22. The stem 20 of the balloon 18 is made accessible near the adjustment band of the cap, and air is pumped, or blown, into the balloon until the cap crown is stretched smooth. The ribbed cage member is preferably plastic and semi-rigid as upon sufficient inflation the unexpected result is a desirable topside convex bowing of the bill of a cap.

Figure 2:
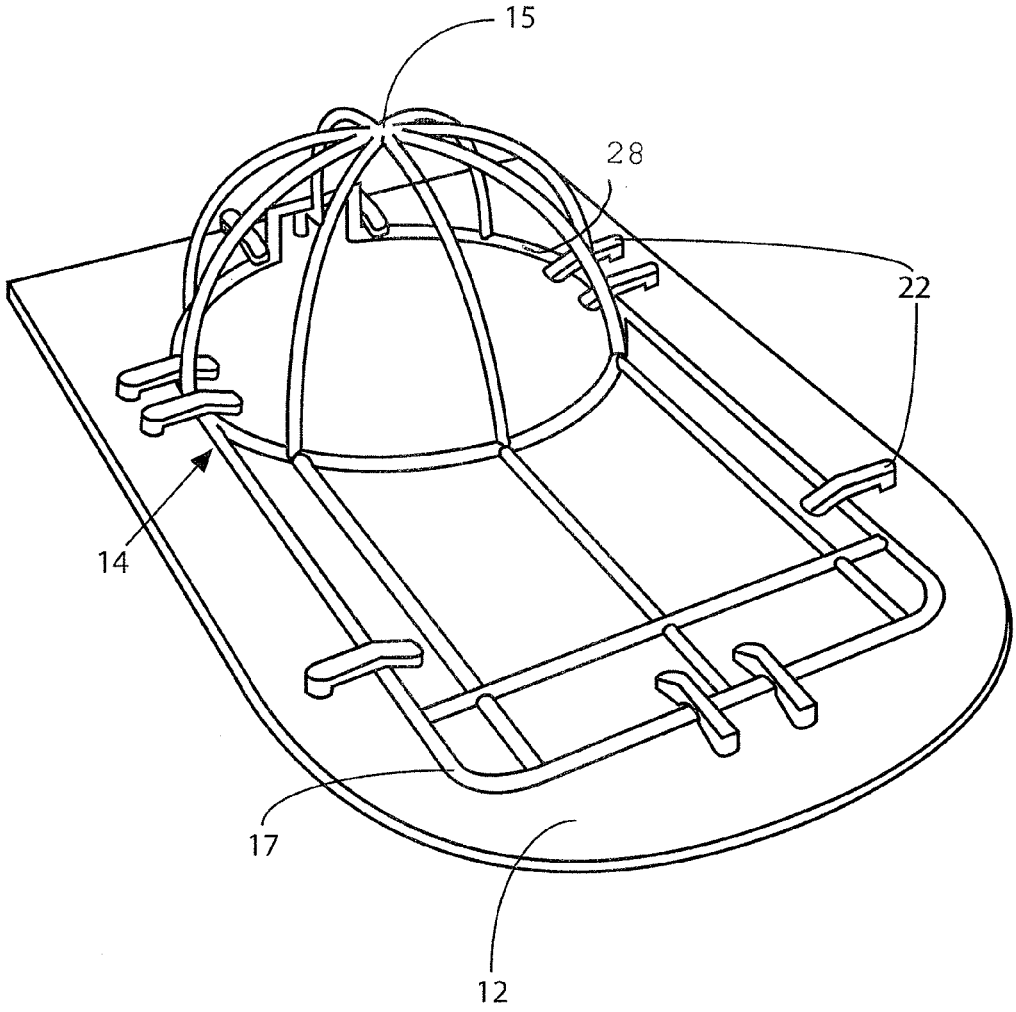
FIG. 2 provides a perspective view of the present invention assembled without a hat.

FIG. 2 provides a perspective view of the present invention assembled without a cap and balloon in place. The base 12 has a multiplicity of spring-loaded clamps 22 adjacent the perimeter for clamping on the ribbed cage 14, which includes both the dome section 15 and the planar section 17. For use, the ribbed cage 14 is removed from the base 12 by releasing the clamps 22. The cap to be dried, with a balloon or inflatable bladder in the crown section, is placed on the base 12. The slightly flexible ribbed cage 14 is then placed over the cap in the obvious manner. The stem of the balloon is made accessible near the adjustment band of the cap, and air is pumped, or blown, into the balloon until the cap crown is stretched smooth. At full inflation of the balloon 18, the bill of the cap becomes curved and lifts up the center portion of the plastic cage 17 if the plastic is semi-rigid. The base ring 28 of the ribbed cage 14 is firmly held to the planar base 12 by the clamps 22.

Figure 3:
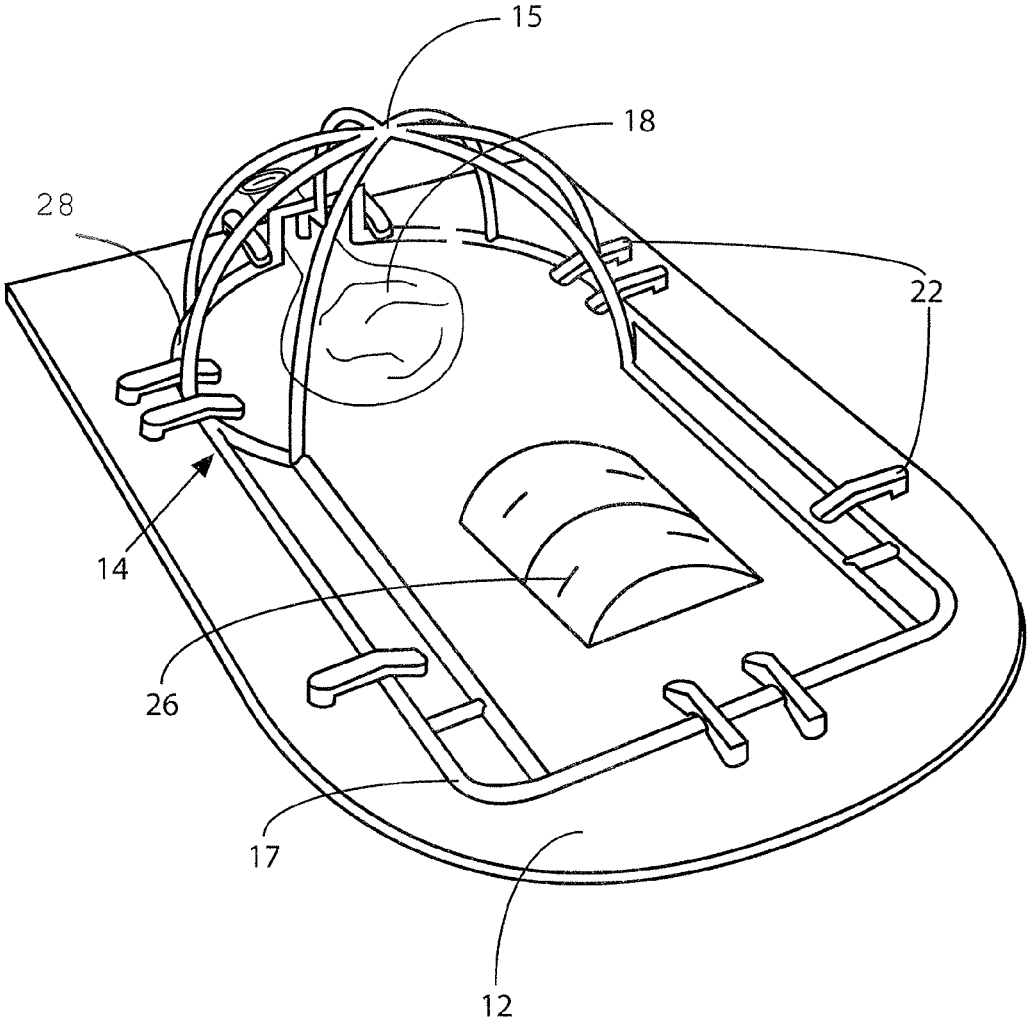
FIG. 3 provides a perspective view of an alternative embodiment of the present invention.

FIG. 3 is a perspective view of an alternative embodiment of the present invention designed to accommodate those who want to ensure a curved bill on their ball caps. The base 12 has a multiplicity of spring-loaded clamps 22 adjacent the perimeter for clamping on the ribbed cage 14, which includes both the dome section 15, the base ring 28, and the planar section 17. In this case, the ribbed cage member 15 and 17 may be either rigid or semi-flexible. However, in this embodiment, the planar section 17 is void of ribs in the central portion, and a portion of the dome 15 ribs have been removed adjacent where the proximal end of the bill of the cap will reside. An arcuate block 26 is fixedly attached to the base 12 adjacent the center and positioned to fit under the bill of the cap. This forces or maintains some curvature in the bill as the cap is drying.

While a presently preferred and various alternative embodiments of the present invention have been described in sufficient detail above to enable a person skilled in the relevant art to make and use the same, it should be obvious that various other adaptations and modifications can be envisioned by those persons skilled in such art without departing from either the spirit of the invention or the scope of the appended claims.

I claim:

1. A cap drying and shaping apparatus comprising:

a) a substantially planar base with a first predetermined length and a first predetermined width;

b) an inflatable bladder disposed on a surface of said planar base proximal one end thereof;

c) a ribbed cage member, said ribbed cage member including:

i) a domed portion having a predetermined radius to an apex and a base ring with a predetermined diameter parallel to said planar base; and ii) a substantially planar portion being void of ribs and having a second predetermined width and a second predetermined length, said substantially planar portion fixedly attached to a portion of said base ring of said domed portion;

d) an attachment means disposed on top of and adjacent a peripheral edge of said planar base for removably holding said ribbed cage member to said planar base; and (e) wherein said inflatable bladder is positioned under said domed portion of said ribbed cage member being disposed on said planar base.

2. The cap drying and shaping apparatus, according to claim 1, wherein said planar base includes an arcuate convex hump disposed in a central portion of said planar base and further disposed within said substantially planar portion of said rib cage member.

3. The cap drying and shaping apparatus, according to claim 1, wherein said inflatable bladder is a substantially round latex rubber balloon.

4. The cap drying and shaping apparatus, according to claim 1, wherein said predetermined radius and diameter are marginally larger than an exterior of a crown in a typical ball cap.

5. The cap drying and shaping apparatus, according to claim 1, wherein said attachment means is a plurality of spaced spring-loaded clamps disposed along the peripheral edge of said planar base.

6. The cap drying and shaping apparatus, according to claim 1, wherein said attachment means is a plurality of spaced hook and loop strips.

7. The cap drying and shaping apparatus, according to claim 1, wherein said second predetermined length is shorter than said first predetermined length and at least as long as a bill on a typical ball cap.

8. The cap drying and shaping apparatus, according to claim 1, wherein said second predetermined width is narrower than said first predetermined width and at least as wide as a bill on a typical ball cap.

9. The cap drying and shaping apparatus, according to claim 1, wherein said first predetermined length is longer than that of a typical ball cap and said first predetermined width is at least as wide as that of a bill on the typical ball cap.

10. An apparatus for drying and shaping a cap having a bill, said apparatus comprising:

a) a base;

b) an inflatable bladder disposed on said base and having an inflation stem protruding past one edge of said base;

c) means for removably holding a cap cage member on said base;

d) a dome shaped portion;

(e) a base ring disposed on an open end of said dome shaped portion;

(f) an arcuate block fixedly attached to said base and disposed within said central portion of said substantially planar portion;

(g) a substantially planar section fixedly attached to a portion of said base ring wherein said substantially planar portion is void of ribs in a central portion thereof; and (h) whereby said base ring and said substantially planar section positioned on said base are disposed generally parallel thereto.

11. The apparatus of claim 10, wherein said dome shaped portion is ribbed.

12. The apparatus of claim 10, wherein said means includes a plurality of clamps.

13. The apparatus of claim 1, wherein a surface area of said planar base is greater than footprint area of said ribbed cage member.

14. The apparatus of claim 1, wherein said first predetermined length and said first predetermined width of said planar base form a rectangular surface wherein a portion of said attachment means is disposed along each edge of said rectangular surface.

* * * * *